United States Patent [19]

Kopp et al.

[11] 4,350,035

[45] Sep. 21, 1982

[54] METHOD OF SHAPING OBJECTS BY MEANS OF A SOLID-PARTICLE BLAST APPLIED TO ONE SIDE THEREOF

[76] Inventors: Reiner Kopp, Kelmiser Strasse 13; Klaus-Peter Hornauer, Nizzaallee 79, both of Aachen, Fed. Rep. of Germany

[21] Appl. No.: 121,421

[22] Filed: Feb. 14, 1980

[30] Foreign Application Priority Data

Feb. 20, 1979 [DE] Fed. Rep. of Germany ..... 2906509

[51] Int. Cl.[3] ..... B24C 1/10

[52] U.S. Cl. ..... 72/53

[58] Field of Search ..... 72/53, 40; 51/319

[56] References Cited

U.S. PATENT DOCUMENTS 2,701,408 2/1955 Borger ..... 72/53

3,000,425 9/1961 Hodges ..... 72/53

FOREIGN PATENT DOCUMENTS 857027 12/1960 United Kingdom .

1320748 6/1973 United Kingdom .

1344323 1/1974 United Kingdom .

OTHER PUBLICATIONS

*Metall* "Shot-Peenforming", vol. 31, No. 4, (Apr. 1977), pp. 362-364, Germany.

*Aluminium* "A Study in the Peen-Forming of Metals", vol. 54, No. 3, (1978), pp. 203-206, United Kingdom.

*Aircraft Production* "Shot-Peen Forming", Oct. 1958, pp. 374-378, United Kingdom.

*Primary Examiner*—Gene Crosby

*Attorney, Agent, or Firm*—Holman & Stern

[57] ABSTRACT

A method is provided for shaping an object consisting of a material which is both elastic and capable of permanent deformation, by deforming said object with a blast of solid particles.

14 Claims, 12 Drawing Figures

FIG.1
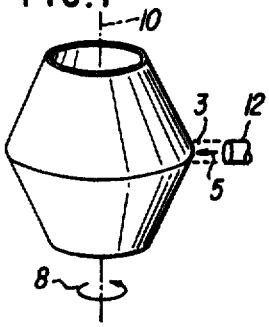
FIG.2
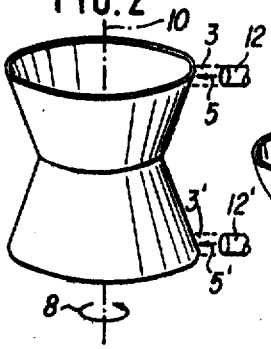
FIG.3
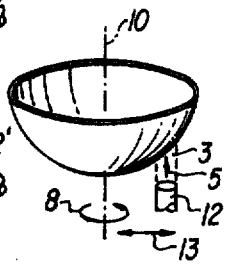
FIG.4
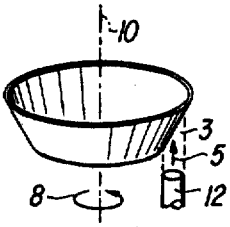
FIG.5
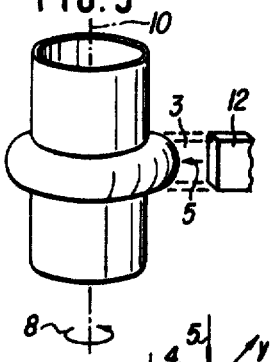
FIG.6
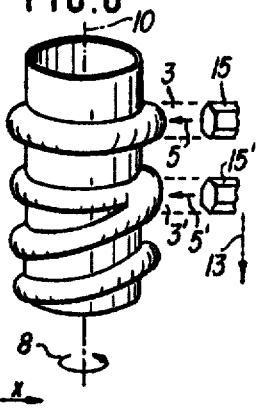
FIG.7
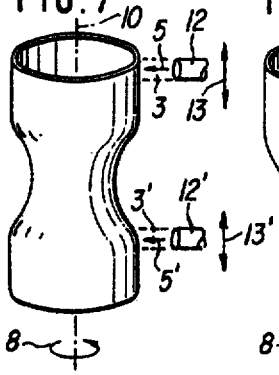
FIG.8
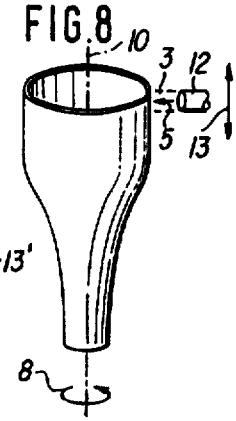
FIG.9
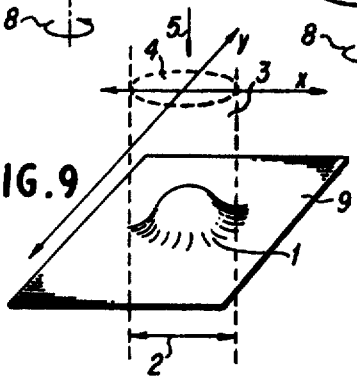
FIG.10
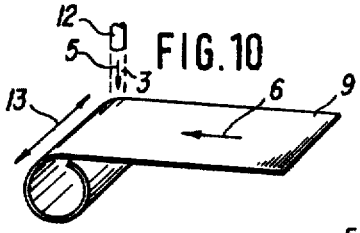
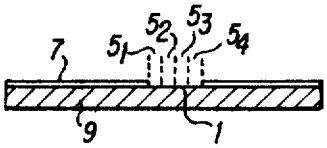
FIG.12
FIG.11
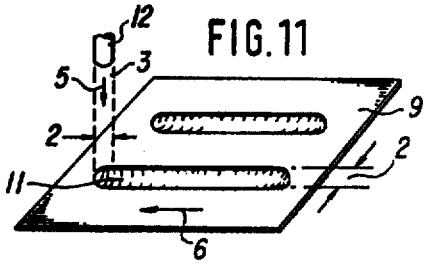

METHOD OF SHAPING OBJECTS BY MEANS OF A SOLID-PARTICLE BLAST APPLIED TO ONE SIDE THEREOF

BACKGROUND OF THE INVENTION

This invention relates to a method of shaping an object by deforming it with a blast of solid particles.

Among the various known methods of prior art is the ball-shot deformation process, which is described in "Metall" 1977, pages 362–364. According to this process, spherical, or ball-shot blasts which are applied to the surface of the object to be shaped imprint compressive stresses in the superficial layers of the object entailing elongation of the entire surface layer. Furthermore, in the substrate layer tensile stresses are set up resulting in elastic elongation. Since this process can be applied freely, that is to say, without the aid of shaping tools, it has already been widely adopted in the aircraft construction industry for making radiussed wing surfaces and fuselage panels. Any potentially existing differences in respect of section modulus (resistance moments) of the parts is allowed for by an appropriate choice of intensity in the application of the blasting process. Deformations obtained in this fashion are comparable to deformations produced by bending, however, there is a different internal stress distribution in the material. Still more extensive deformations of components can be achieved by increasing blasting pressures and this will result in a reversal of the direction of deformation in the sense that in the area which is subjected to increased blasting pressure the object curves, or arcs towards the opposite side and no longer in the direction towards the blasting source as is normally the case.

SUMMARY OF THE INVENTION

It is the aim of the present invention to enable deformations being obtained by application of the method hereinbefore specified which go beyond the degree of deformation normally achievable by bending methods. Moreover, the method is to be applicable not only to the shaping of panels or like parts but also to shaping objects which present a continuous, endless surface, that is to say, including hollow cylindrical objects and the like.

Previously it was customary to apply the blast over an area of considerable size to the whole of the surface of the object which was to be shaped, the method according to the present invention provides that the blast is applied to a region of the object which is confined to precisely predetermined limits. The proposed particle-blast cross section of this invention is measured perpendicularly relative to the direction of particle jet propagation. In other words, the cross sectional configuration of the blast is either round or at most a shallow oval, or approximately square or of similar polygonal form. The last mentioned cross sectional configuration, while being somewhat more difficult to realize for a particle blast or jet has considerable advantages where it is necessary to form a combined particle blast from a plurality of separate particle jets; for in that case it is possible to work without clear spaces or gaps between the individual jets which are unavoidable with circular or similar cross-sections.

Relative movement between the object and the particle jet does not enlarge the area which is exposed to the blast in respect of its width but can only add to the length of this area. In other words such movement does not result in the blast application covering a large area and the initially selected limitation of the treated region is preserved. Relative movement may however also be applied in the direction of propagation of the particle jet, for example if the amount of kinetic energy per area unit is to be varied in the course of a blasting operation. In that event the width of the defined area will be increased if, with increasing distance from the blasting nozzle the jet itself widens out. To counter this the region which is subjected to blasting may be decreased in size. Coatings may be provided for all or part of the object to be deformed, applied to the object in such a way as to brake or absorb the kinetic energy of the particle jet so that no compressive strains will be imprinted in the surface of the object in these regions. These requirements are particularly well met by conventional self-adhesive foils or by elastic paint coatings.

The relative movement may notably be a rotational movement if the treated object happens to be a body of revolution, e.g. a tube section.

For the practical implementation of the present invention a basic distinction between two different situations applies, namely either high deformation or weak deformation work. Such differential deformation intensity can be controlled particularly by varying the effective application time of the particle jet. High deformations enable the shaping of forms which are normally obtainable only by deepdrawing, pressing, swaging or high-speed forming methods. However, while the above mentioned conventional shaping methods are, expensive in view of the special tools needed for their application and, their practical application is limited by the ultimate appearance of cracks in the surface of the treated object, the method according to this invention requires no tools at all. This makes its application particularly attractive with regard to materials which combine a low elasticity module with a high yield point ratio, such as for example titanium. Deformation work of this kind cannot be obtained by bending methods.

The earlier mentioned alternative application of the invention at a weak deformation rate allows basically elastic strains to be created in hollow bodies having a continuous surface, e.g. bodies of revolution or rotational bodies. In this case deformation is confined to a portion or section of the peripheral surface of such an object. In this way it is possible to impart a desired shape or form to metals which are notoriously difficult to deform by conventional methods, such as titanium. Above all, it is possible by deformation to achieve a stretching or elongation of the region to which the blasting process has been applied in consequence of which an elastic tension can be set up in the object as a whole. Thus comparatively minor deformations can be applied to an easily accessible region of an object with the result that the object thus treated will change its shape as a whole, i.e. also in inaccessible regions thereof. This is of practical value notably in the case of tube sections the insides in which are inaccessible, and also of unilaterally closed bodies of revolution such as hollow cones or rotation-paraboloids.

BRIEF DESCRIPTION OF THE DRAWINGS

FIG. 1 is a perspective view of a workpiece deformed according to this invention by directing a particle jet toward the middle of a rotating cylinder FIG. 2 is a perspective view of a workpiece deformed according to this invention by directing a particle jet toward the ends of a rotating cylinder.

FIG. 3 is a perspective view of a workpiece deformed according to this invention by directing a particle jet upward from below a rotating disc across the diameter of the disc.

FIG. 4 is a perspective view of a workpiece deformed according to this invention by directing a particle jet upward from below a rotating disc across the diameter of the disc wherein the central region of the disc has a kinetic energy braking or absorbing coating.

FIG. 5 is a perspective view of a workpiece deformed according to this invention by directing a particle jet toward the middle of a rotating cylinder.

FIG. 6 is a perspective view of a workpiece deformed according to this invention by directing a particle jet toward the surface of a rotating cylinder and moving the nozzle parallel to the axis of rotation.

FIG. 7 is a perspective view of a workpiece deformed according to this invention by directing a particle jet nozzle toward the upper and lower portions of a rotating cylinder.

FIG. 8 is a perspective view of a workpiece deformed according to this invention by directing a particle jet toward the upper portion of a rotating cylinder.

FIG. 9 is a perspective view of a workpiece deformed according to this invention by directing a particle jet downward toward a plate at a single point.

FIG. 10 is a perspective view of a workpiece deformed according to this invention by directing a particle jet normal to the plane of a sheet and advancing the sheet longitudinally in a horizontal direction while moving the particle jet horizontally and perpendicularly to the direction of sheet advance.

FIG. 11 is a perspective view of a workpiece deformed according to this invention by directing a particle jet normal to the plane of a sheet and moving the jet in a straight line relative to the sheet to form successive linear deformations.

FIG. 12 is a side planar view through one surface of a workpiece which can be a body of revolution prior to deformation illustrating a regionally adhering coating of an exposed surface to be deformed by a particle jet.

DESCRIPTION OF THE PREFERRED EMBODIMENTS

FIGS. 1 to 11 illustrate objects which were subjected to a deformation process according to the present invention. The objects represented in FIGS. 1 and 2, and in FIGS. 5 to 8 were made from initially cylindrical tube sections. The transition to the deformed regions appears sharp-edged in FIGS. 1, 2, 5 and 6 but is actually slightly rounded. The much more gradual rounding in the objects according to FIGS. 7 and 8 was deliberately induced to provide aerodynamic shaping.

The objects shown in FIGS. 3 and 4 were made from circular discs which have been shaped into small containers by application of the method according to this invention.

The effective applictaion of the blast to just one single point will be noted in the object shown in FIG. 9 which was made from a sheet metal panel. By contrast FIG. 11 shows an object, also made from such a panel, which comprises a pair of relatively parallel longitudinally extending depressions. In this case a rectilinear relative movement was applied for one of these depressions at a time in the course of the blasting process.

Lastly, the object shown in FIG. 10 illustrates the facility of deforming at a variable radius of curvature. This object is a product made from approx. 1 mm thick titanium sheet. Even if one tried to produce this object by rolling up the strip blank, it simply could not be made because of its elastic properties which would always cause it to unwind again. Nor can the coiled or rolled up shape which was successfully obtained by application of the method according to this invention be produced by any other conventional deforming process.

FIGS. 1 through 8 are all bodies of revolution having a central axis 10, which are revolved in direction 8 or its reverse. In FIGS. 1 through 11, nozzles 12, 12', 15, 15' direct a particle stream 3, 3' in direction 5, 5' against the respective workpieces.

FIG. 2 shows a nozzle 12, particle stream 3 and direction 5 in a first position and a nozzle 12', particle stream 3' and direction 5' in a second position. In various Figures, the same nozzle may be applied to the two positions sequentially, or two nozzles may be used simultaneously. The direction of nozzle motion 13 in FIGS. 1, 2, and 5 through 8 is parallel to the central axis 10. The direction of nozzle motion 13 in FIGS. 3 and 4 is perpendicular to the central axis 10. In FIG. 6, nozzle 15 is in the shape of a regular polygon. This does not affect the shape of the deformation when the workpiece and nozzle are moved relative to one another.

FIGS. 9 through 11 show deformation of a planar sheet 9 which is not revolved. In FIG. 9, coordinates x and y define the cross-sectional area 4 of the particle stream 3 having direction 5, which produces a deformation 7 having a diameter 2 which is about the same as the diameter of cross-sectional area 4. In FIG. 10, nozzle 12 is moved reciprocally in direction 13 while sheet 9 advances in direction 6. In FIG. 12, $5_1$ through $5_4$ represent particle streams impinging on plate 9 at surface 1 whose impingement effect is shielded by regionally adhering coating 7.

In practice the amount of deformation applied is essentially controlled, as already mentioned, by the time of effective application of the particle blast. Cast-steel ball shot may be used as a blasting medium for shaping steel or glass balls for shaping aluminum.

Virtually maximum deformation can be obtained if 100% cover has been achieved. A known means for monitoring deformation is the "Almen test" which is described in "Aluminium", 1978, pages 203 to 206.

The particles are ejected in one or more jets preferably, from nozzles with diameters between 3 and 15 mm, particularly between 6 and 10 mm, at a ball-shot velocity of between 10 and 90 m/s. The size of the ballshot may be between 0.2 mm and 4 mm, but this is subject to classification, covering, for example, diameter ranges of 0.5 mm each. Thus one can optionally work with shot of class 0.5 to 1.0 mm, or 1.0 to 1.5 mm, or 2.0 to 2.5 mm, or 3.0 to 3.5 mm, for application, e.g. to sheet steel material between 1 and 4 mm thickness. A convenient propelling or blasting vehicle for the ball shot is compressed air, blasting pressure being adjustable from 0.5 to 10 bar.

Alongside the above described effects and results obtained according to this invention substantial improvements can also be achieved in respect of fatigue strength and stress-crack-corrosion without for this purpose having to apply further provisions additional to those hereinbefore proposed.

We claim:

1. In a method of shaping a workpiece consisting of a material capable of elastic and permanent deformation and which is regionally deformable in at least one direction, wherein a solid particle jet of a blasting medium is effectively applied to one side of the workpiece with a ratio of kinetic-energy to surface-area which depends on the thickness and strength of the material, the improvement comprising:

subjecting a defined geometrically regular surface area of the workpiece to deformation by impingement of at least one solid particle blast jet means directed substantially perpendicular to the defined surface area by moving the workpiece and the particle jet relative to each other, wherein any cross-section of the solid particle blast jet taken at a right angle to the direction of propagation defines a geometric planar figure substantially the same size as that of the defined surface area, and wherein deformation is substantially uniform about the center of the defined surface area; whereby the defined surface area is deformed toward the solid particle blast means to a degree beyond that which can be achieved by bending other than by using solid particle blast means, and wherein the workpiece utilized is a body of revolution and the relative motion is a rotation of the workpiece about its longitudinal axis.

2. The method of claim 1 wherein the deformation is elongated in the direction of said movement.

3. The method of claim 1 wherein the workpiece is a cylindrical tube.

4. The method of claim 1 wherein the deformation is confined to a region or section of the workpiece's peripheral wall surface.

5. The method of claim 1 wherein the overall shaping of the workpiece is obtained by virtue of elastic strains set up in the workpiece by deforming one region or section thereof.

6. The method of claim 1 wherein a surface of the workpiece is provided with a regional adhering coating before exposure to the solid particle blast jet, said coating being capable of braking or absorbing the kinetic energy of the particle jet so that no compressive strains are imprinted on the surface of the workpiece in the coated region.

7. The method of claim 6 wherein the coating is an adhesive foil.

8. The method of claim 6 wherein the coating is an elastic paint.

9. The method of claim 1 wherein the defined surface area is substantially round.

10. The method of claim 1 wherein the defined surface area is a regular polygon.

11. The method of claim 1 wherein the defined surface area is a shallow oval.

12. The method of claim 1 wherein the defined surface area is approximately square.

13. The method of claim 9, 10, 11 or 12 wherein a plurality of separate solid particle blast jet means are used.

14. The method of claim 10 or 12 wherein a plurality of separate solid particle blast jet means are used which each deform a defined surface area having at least one side in common with an adjacent defined surface area.

* * * * *